US007857309B2

(12) United States Patent
Moore

(10) Patent No.: US 7,857,309 B2
(45) Date of Patent: Dec. 28, 2010

(54) SHAFT DRIVING APPARATUS

(75) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 429 days.

(21) Appl. No.: 11/590,432

(22) Filed: Oct. 31, 2006

(65) Prior Publication Data

US 2008/0099984 A1 May 1, 2008

(51) Int. Cl.
*B65H 39/10* (2006.01)

(52) U.S. Cl. ..... 271/303; 192/56.1; 464/46

(58) Field of Classification Search ..... 271/303–305; 464/30, 34–48; 192/56.1, 56.2
See application file for complete search history.

(56) References Cited

U.S. PATENT DOCUMENTS 4,055,370 A * 10/1977 Cunningham ..... 384/130
4,416,450 A * 11/1983 van Wijngaarden ..... 271/303
4,579,446 A 4/1986 Fujino et al.
4,587,532 A 5/1986 Asano
4,836,119 A 6/1989 Siraco et al.
5,004,222 A 4/1991 Dobashi
5,008,713 A 4/1991 Ozawa et al.
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.
5,884,910 A 3/1999 Mandel
5,995,721 A 11/1999 Rourke et al.
6,059,284 A 5/2000 Wolf et al.

(Continued)

FOREIGN PATENT DOCUMENTS

JP 62-167165 * 7/1987

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Stefanos Karmis
*Assistant Examiner*—Thomas A Morrison
(74) *Attorney, Agent, or Firm*—Fay Sharpe LLP

(57) ABSTRACT

This disclosure provides a shaft driving apparatus and method of operation. The shaft driving apparatus comprises a shaft and a slip joint configuration to extend the wear zone associated with bearings operatively connected to an apparatus which rotates a shaft less than 360 degrees in an oscillatory manner or other cyclical manner.

12 Claims, 7 Drawing Sheets

U.S. PATENT DOCUMENTS

| | | | |
|---|---|---|---|
| 6,125,248 | A | 9/2000 | Moser |
| 6,241,242 | B1 | 6/2001 | Munro |
| 6,297,886 | B1 | 10/2001 | Cornell |
| 6,341,773 | B1 | 1/2002 | Aprato et al. |
| 6,384,918 | B1 | 5/2002 | Hubble, III et al. |
| 6,450,711 | B1 | 9/2002 | Conrow |
| 6,476,376 | B1 | 11/2002 | Biegelsen et al. |
| 6,476,923 | B1 | 11/2002 | Cornell |
| 6,493,098 | B1 | 12/2002 | Cornell |
| 6,537,910 | B1 | 3/2003 | Burke et al. |
| 6,550,762 | B2 | 4/2003 | Stoll |
| 6,554,276 | B2 | 4/2003 | Jackson et al. |
| 6,577,925 | B1 | 6/2003 | Fromherz |
| 6,607,320 | B2 | 8/2003 | Bobrow et al. |
| 6,608,988 | B2 | 8/2003 | Conrow |
| 6,612,566 | B2 | 9/2003 | Stoll |
| 6,612,571 | B2 | 9/2003 | Rider |
| 6,621,576 | B2 | 9/2003 | Tandon et al. |
| 6,633,382 | B2 | 10/2003 | Hubble, III et al. |
| 6,639,669 | B2 | 10/2003 | Hubble, III et al. |
| 6,819,906 | B1 | 11/2004 | Herrmann et al. |
| 6,925,283 | B1 | 8/2005 | Mandel et al. |
| 6,959,165 | B2 | 10/2005 | Mandel et al. |
| 6,973,286 | B2 | 12/2005 | Mandel et al. |
| 7,024,152 | B2 | 4/2006 | Lofthus et al. |
| 2002/0078012 | A1 | 6/2002 | Ryan et al. |
| 2002/0103559 | A1 | 8/2002 | Gartstein |
| 2003/0077095 | A1 | 4/2003 | Conrow |
| 2004/0085561 | A1 | 5/2004 | Fromherz |
| 2004/0085562 | A1 | 5/2004 | Fromherz |
| 2004/0088207 | A1 | 5/2004 | Fromherz |
| 2004/0150156 | A1 | 8/2004 | Fromherz et al. |
| 2004/0150158 | A1 | 8/2004 | Biegelsen et al. |
| 2004/0153983 | A1 | 8/2004 | McMillan |
| 2004/0216002 | A1 | 10/2004 | Fromherz et al. |
| 2004/0225391 | A1 | 11/2004 | Fromherz et al. |
| 2004/0225394 | A1 | 11/2004 | Fromherz et al. |
| 2004/0247365 | A1 | 12/2004 | Lofthus et al. |
| 2006/0033771 | A1 | 2/2006 | Lofthus et al. |
| 2006/0039728 | A1 | 2/2006 | deJong et al. |
| 2006/0066885 | A1 | 3/2006 | Anderson et al. |
| 2006/0067756 | A1 | 3/2006 | Anderson et al. |
| 2006/0067757 | A1 | 3/2006 | Anderson et al. |
| 2006/0114313 | A1 | 6/2006 | Moore |
| 2006/0114497 | A1 | 6/2006 | Anderson et al. |
| 2006/0115284 | A1 | 6/2006 | Grace et al. |
| 2006/0115287 | A1 | 6/2006 | Roof |
| 2006/0115288 | A1 | 6/2006 | Roof |
| 2006/0132815 | A1 | 6/2006 | Lofthus et al. |

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,450, filed Nov. 30, 2004, Lofthus et al.
U.S. Appl. No. 11/000,168, filed Nov. 30, 2004, Biegelsen et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, field Apr. 13, 2006, Banton et al.
U.S. Appl. No. 11/399,100, filed Apr. 6, 2006, Paul.
U.S. Appl. No. 11/417,411, filed May 4, 2006, DeGruchy.
U.S. Appl. No. 11/432,924, filed May 12, 2006, Lieberman et al.
U.S. Appl. No. 11/432,905, filed May 12, 2006, Mongeon et al.
U.S. Appl. No. 11/432,993, filed May 12, 2006, Anderson.
U.S. Appl. No. 11/487,206, filed Jul. 14, 2006, Wu et al.
U.S. Appl. No. 11/485,870, filed Jul. 13, 2006, Moore.
U.S. Appl. No. 11/474,247, filed Jun. 23, 2006, Moore.
U.S. Appl. No. 11/483,747, filed Jul. 6, 2006, Meetze.
U.S. Appl. No. 11/495,017, filed Jul. 28, 2006, Bean.
U.S. Appl. No. 11/501,654, filed Aug. 9, 2006, Mestha et al.
U.S. Appl. No. 11/522,171, filed Sep. 15, 2006, Sampath et al.
U.S. Appl. No. 11/528,770, filed Sep. 27, 2006, Degruchy.
U.S. Appl. No. 11/545,176, filed Oct. 10, 2006, deJong et al.

* cited by examiner

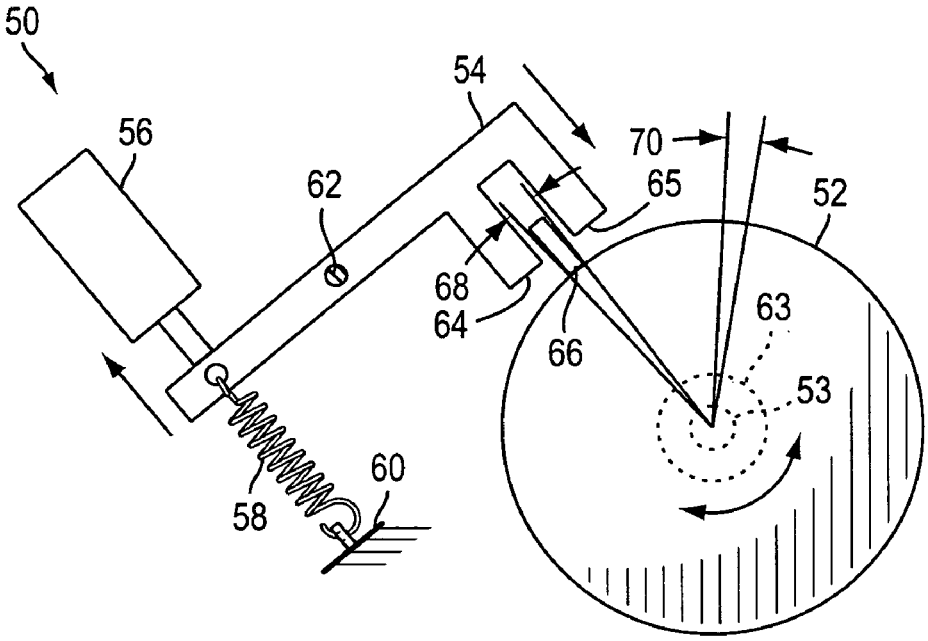

FIG. 2

| | STEP | DESCRIPTION |
|---|---|---|
| 82 | 1 | NORMAL OPERATION IS SUSPENDED TO ALLOW LIMITED SLIP TO OCCUR |
| 84 | 2 | SOLENOID IS ENERGIZED BY CONTROLLER |
| 86 | 3 | HARD STOP PIVOTS INTO POSITION WITH RESPECT TO LOAD FEATURE |
| 88 | 4 | MOTOR ROTATES SHAFT SO THAT LOAD CONTACTS HARD STOP AND LIMITED SLIP JOINT SLIPPAGE |
| 90 | 5 | MOTOR STOPS |
| 92 | 6 | SOLENOID IS DE-ENERGIZED AND HARD STOP PIVOTS AWAY FROM CONTACT WITH LOAD |
| 94 | 7 | NORMAL OPERATION RESUMES |

FIG. 3

FIG. 9A
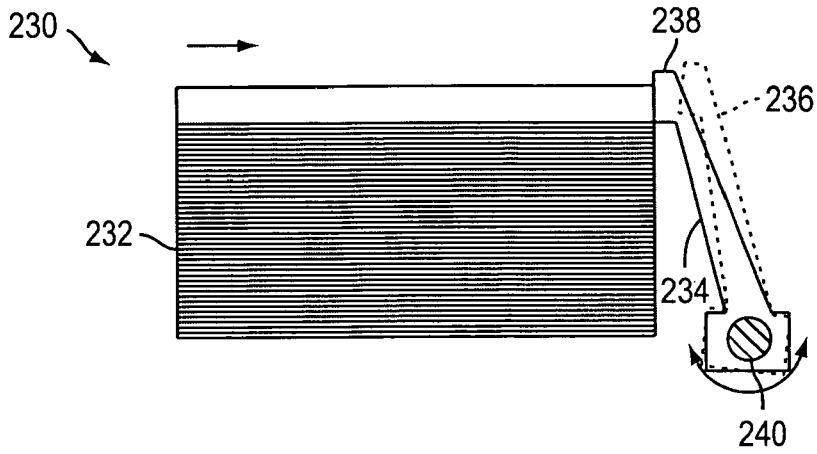
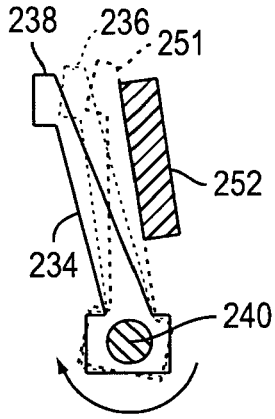
FIG. 9B
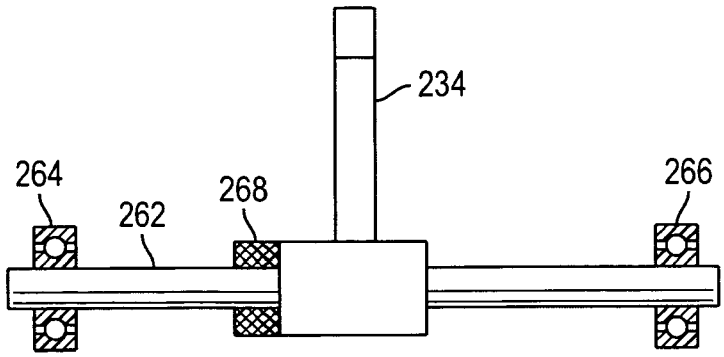
FIG. 9C

SHAFT DRIVING APPARATUS

CROSS REFERENCE TO RELATED PATENTS AND APPLICATIONS

The following patents/applications, the disclosures of each being totally incorporated herein by reference are mentioned:

U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application No. US-2006-0012102-A1, published Jan. 19, 2006, entitled "FLEXIBLE PAPER PATH USING MULTIDIRECTIONAL PATH MODULES," by Daniel G. Bobrow;

U.S. Publication No. US-2006-0033771-A1, published Feb. 16, 2006, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.;

U.S. Publication No. US-2006-0039728-A1, published Feb. 23, 2006, entitled "PRINTING SYSTEM WITH INVERTER DISPOSED FOR MEDIA VELOCITY BUFFERING AND REGISTRATION," by Joannes N. M. dejong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. Publication No. US-2006-0132815-A1, Published Jun. 22, 2006, entitled "PRINTING SYSTEMS," by Robert M. Lofthus, et al.;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/093,229, filed Mar. 29, 2005, entitled "PRINTING SYSTEM," by Paul C. Julien;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,566, filed Apr. 19, 2005, entitled "MEDIA TRANSPORT SYSTEM," by Barry P. Mandel, et al.;

U.S. application Ser. No. 11/122,420, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/156,778, filed Jun. 20, 2005, entitled "PRINTING PLATFORM," by Joseph A. Swift;

U.S. application Ser. No. 11/157,598, filed Jun. 21, 2005, entitled "METHOD OF ORDERING JOB QUEUE OF MARKING SYSTEMS," by Neil A. Frankel;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/331,627, filed Jan. 13, 2006, entitled "PRINTING SYSTEM INVERTER APPARATUS", by Steven R. Moore;

U.S. application Ser. No. 11/349,828, filed Feb. 8, 2005, entitled "MULTI-DEVELOPMENT SYSTEM PRINT ENGINE", by Martin E. Banton;

U.S. application Ser. No. 11/359,065, filed Feb. 22, 2005, entitled "MULTI-MARKING ENGINE PRINTING PLATFORM", by Martin E. Banton;

U.S. application Ser. No. 11/364,685, filed Feb. 28, 2006, entitled "SYSTEM AND METHOD FOR MANUFACTUR- ING SYSTEM DESIGN AND SHOP SCHEDULING USING NETWORK FLOW MODELING", by Hindi, et al.;

U.S. application Ser. No. 11/378,046, filed Mar. 17, 2006, entitled "PAGE SCHEDULING FOR PRINTING ARCHITECTURES", by Charles D. Rizzolo, et al.; and U.S. application Ser. No. 11/378,040, filed Mar. 17, 2006, entitled "FAULT ISOLATION OF VISIBLE DEFECTS WITH MANUAL MODULE SHUTDOWN OPTIONS", by Kristine A. German, et al.

BACKGROUND

This disclosure relates to a shaft driving apparatus and method of operation. The disclosed shaft driving apparatus and method of operation are especially relevant to applications where a bearing supported shaft is oscillated a relatively small angular range. One example of a bearing supported shaft which is oscillated a relatively small angular range is a printing apparatus decision gate for directing a print media sheet along one of multiple paths.

With reference to FIGS. 10A and 10B, illustrated is a front and end view, respectively, of a conventional shaft driving apparatus 280 and associated load 288. The shaft driving apparatus 280 includes a controller 282, a motor 284, a shaft 286, a load 288, a coupler 302, a first bearing 306, a second bearing 308, and a rigid joint 304 which couples the load 288 and shaft 286. In operation, the controller 282 and/or motor 284 rotate the shaft 286 which rides on the bearings, 306 and 308, to rotate the rigid coupler 304 and load 288.

With regard to the wear of the bearings, eventually one or more of the ball bearings housed within the bearing structure will fail and require replacement. In addition, bearings housed within the motor will eventually need replacement. For applications of the shaft driving apparatus 280 which require complete rotations of the shaft 286, the bearings and all associated bearing balls housed within a particular bearing housing tend to wear at a relatively uniform rate. However, for applications of the shaft driving apparatus 280 which require repetitive incomplete rotations of the shaft where the shaft rotates from a first angular position to a second angular position less than a full rotation of the shaft, the associated bearing balls within a particular bearing housing tend to wear unevenly. With continued reference to FIG. 10B, illustrated is a conventional shaft driving apparatus 280 where the shaft 286 and load 288 do not rotate a full rotation of the shaft 286. The apparatus 280 rotates an angular motion range 312 less than a complete rotation.

Under the conditions where a shaft is rotated an angular motion range less than 360°, the complete bearing assemblies associated with the shaft fail due to the failure of one or more of the bearing balls housed within the ball bearing assembly.

This disclosure provides a shaft driving apparatus and method of operation to extend the life of bearings where the shaft is repetitively rotated an angular motion range less than 360°. This disclosure is especially suited to an oscillating decision gate and/or tamper arm as used in a printing apparatus. However, the disclosure is not limited to these applications.

BRIEF DESCRIPTION

In one aspect of this disclosure, a shaft driving apparatus is disclosed. The shaft driving apparatus comprises a shaft; a motor, the motor operatively connected to the shaft and the motor including two or more motor bearings for supporting rotational movement of the shaft; and a slip joint, the slip joint including a first portion and a second portion, the slip joint first portion operatively connected to the shaft, and the slip joint second portion is configured to slip at a threshold angle of shaft rotation; wherein the motor is configured to rotate the shaft, the slip joint first and second portions, and the two or more motor bearings a first predetermined angle less than or equal to the threshold angle, and the motor is configured to rotate the shaft, the slip joint first portion, and the two or more motor bearings a second predetermined angle greater than the threshold angle, the slip joint second portion limited to rotating an angle less than or equal to the threshold angle as the shaft, the slip joint first portion, and the two or more motor bearings are rotated the second predetermined angle.

In another aspect of this disclosure, a shaft driving apparatus is disclosed. The shaft driving apparatus comprises a shaft support operatively connected to the shaft, wherein the shaft support includes two or more shaft support bearings for supporting rotational movement of the shaft.

In another aspect of this disclosure, a shaft driving apparatus is disclosed. In the shaft driving apparatus, the motor is configured to rotate the shaft, the two or more shaft support bearings, the slip joint first and second portions and the two or more motor bearings a first predetermined angle less than or equal to the threshold angle, and the motor is configured to rotate the shaft, the two or more shaft support bearings, the slip joint first portion, and the two or more motor bearings a second predetermined angle greater than the threshold angle, the slip joint second portion limited to rotating an angle less than or equal to the threshold angle as the shaft, the two or more shaft support bearings, the slip joint first portion, and the two or more motor bearings are rotated the second predetermined angle.

In another aspect of this disclosure, a shaft driving apparatus is disclosed. The shaft driving apparatus comprises a controller operatively connected to the motor.

In another aspect of this disclosure, a shaft driving apparatus is disclosed. The shaft driving apparatus comprises a slip joint comprising a torque limiting device.

In another aspect of this disclosure, a shaft driving apparatus is disclosed. The shaft driving apparatus comprises a torque limiting device comprising a wrap spring, a magnetic hysteriesis clutch or a friction clutch.

In another aspect of this disclosure, a shaft driving apparatus is disclosed. The shaft driving apparatus comprises an actuating device operatively connected to the slip joint.

In another aspect of this disclosure, a shaft driving apparatus is disclosed. The shaft driving apparatus comprises an actuating device comprising a print media path gate, wherein a first angular position of the gate provides a print media path along a first path and a second angular position of the gate provides a print media path along a second path.

In another aspect of this disclosure, a shaft driving apparatus is disclosed. The shaft driving apparatus comprises an actuating device comprising a print media sheet tamper, wherein a predetermined angular position of the tamper provides alignment of a print media sheet stack.

In another aspect of this disclosure, a shaft driving apparatus is disclosed. The shaft driving apparatus comprises one or more actuating device stops, wherein the actuating device stops prevent the slip joint second portion from rotating to an angle greater than the threshold angle.

In another aspect of this disclosure, a shaft driving apparatus is disclosed. The shaft driving apparatus comprises one or more sensors to control the rotation of the actuating device.

In another aspect of this disclosure, a shaft driving apparatus is disclosed. The shaft driving apparatus comprises a shaft; a motor, the motor operatively connected to the shaft; and a slip joint, the slip joint including a first portion and a second portion, the slip joint first portion operatively connected to the shaft, and the slip joint second portion is configured to slip at a first threshold angular position while the slip joint first portion rotates with a negative angular velocity.

In another aspect of this disclosure, a shaft driving apparatus is disclosed. The shaft driving apparatus comprises a slip joint second portion which is configured to slip at a first threshold angular position while the slip joint first portion rotates with a positive angular velocity.

In another aspect of this disclosure, a shaft driving apparatus is disclosed. The shaft driving apparatus comprises a slip joint second wherein the slip joint second portion is configured to slip at a second threshold angular position while the slip joint first portion rotates with a positive angular velocity.

In another aspect of this disclosure, a shaft driving apparatus is disclosed. The shaft driving apparatus comprises a motor further comprising two or more motor bearings for supporting rotational movement of the shaft.

In another aspect of this disclosure, a shaft driving apparatus is disclosed. The shaft driving apparatus comprises a shaft driving apparatus configured to rotate the shaft, the slip joint first and second portions, and the two or more bearings from a first predetermined angular position to a second predetermined angular position without any slipping, and the shaft driving apparatus configured to rotate the shaft, the slip joint first portion, and the two or more bearings to a third predetermined angular position, the slip joint second portion slipping at an angular position substantially equal to the second predetermined angular position.

In another aspect of this disclosure, a print media apparatus is disclosed. The print media apparatus comprises a shaft; a motor, the motor operatively connected to the shaft, the motor including two or more motor bearings for supporting rotational movement of the shaft; a slip joint, the slip joint operatively connected to the shaft; and a print media path gate, the print media path gate operatively connected to the slip joint, wherein the apparatus is configured to rotate the print media path gate between a first angular position and a second angular position during a normal mode of operation, and the apparatus is configured to rotate the shaft to a third angular position for rotating the two or more motor bearings to a predetermined angular position greater than the second angular position or less than the first angular position.

In another aspect of this disclosure, a print media apparatus is disclosed. The print media apparatus comprises a first angular position of the print media path gate directs print media upwardly, and the second angular position of the print media path gate directs print media downwardly.

In another aspect of this disclosure, a print media apparatus is disclosed. The print media apparatus comprises one or more baffles to guide print media directed by the print media path gate.

In another aspect of this disclosure, a print media apparatus is disclosed. The print media apparatus comprises a rotation of the shaft to the third angular position, rotates the print media path gate to a reference angular position used to control the angular position of the print media path gate.

BRIEF DESCRIPTION OF THE DRAWINGS

FIG. 2 illustrates a shaft driving apparatus according to another exemplary embodiment of this disclosure;

FIG. 3 illustrates an exemplary method of operating a shaft driving apparatus according to an exemplary embodiment of this disclosure;

FIGS. 9A-9C illustrate a print media tamper apparatus according to an exemplary embodiment of this disclosure.

DETAILED DESCRIPTION

As briefly discussed in the background section, this disclosure provides a shaft driving apparatus and method of operation where a shaft and associated load are normally rotated an angular rotation less than 360°. Under these conditions, the disclosed exemplary embodiments provide a means to extend the life of one or more bearing assemblies used to support a shaft and/or any other bearing assemblies used within the apparatus which are operatively coupled to the shaft or load, including motor bearings.

It has been discovered that a localized bearing wear zone results when a shaft and/or load are oscillated within a relatively small angular range. This results from the bearing balls being rotated within the bearing raceway for a relatively small range of motion. Consequently, the local wear zone of the bearing determines the life of the bearing assembly.

To extend the life of the bearing, this disclosure provides a slip joint or torque limiting device which enables a shaft driving apparatus to extend the rolling action of its associated bearings to an angular motion range greater than the normal angular motion range of the load. In operation, the slip joint enables the motor to drive a shaft and associated bearings to an angular position outside the range of travel of the load, thereby providing bearing rolling action for a greater angular range and increasing the life of the bearing assembly.

Figure 1A:
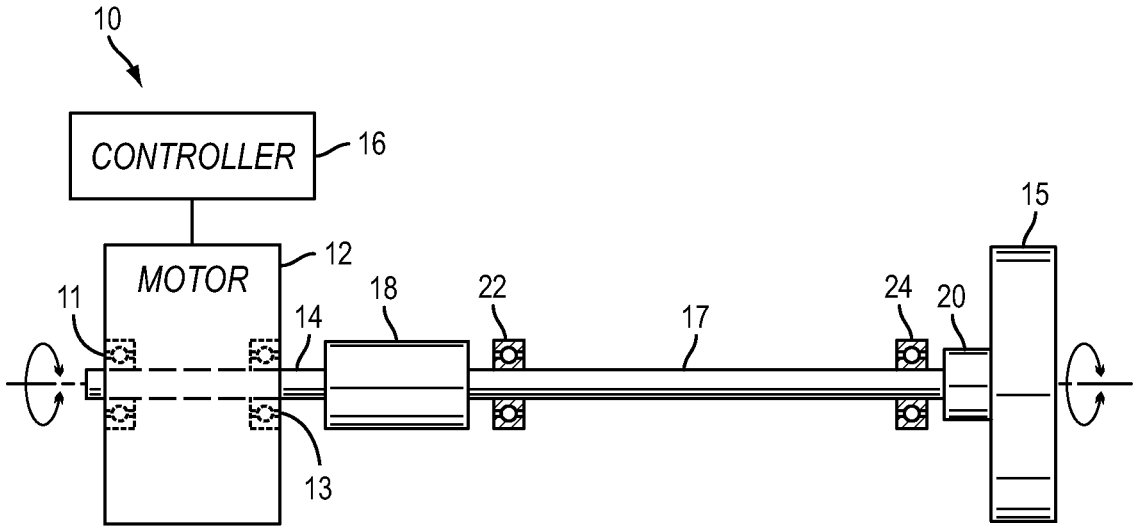
FIGS. 1A and 1B illustrate a shaft driving apparatus according to an exemplary embodiment of this disclosure.
Figure 1B:
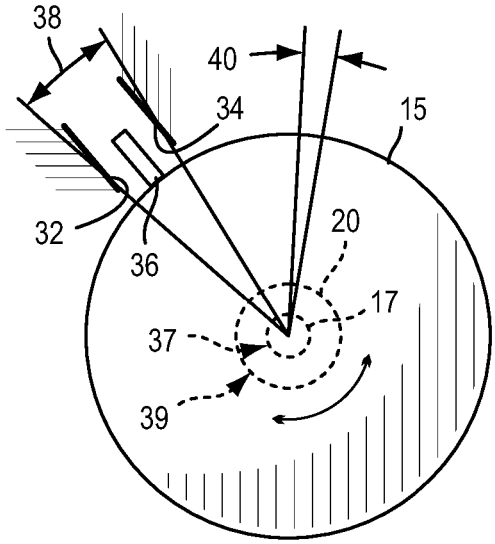

With reference to FIGS. 1A and 1B, illustrated are a front and end view, respectively, of a shaft driving apparatus 10 according to an exemplary embodiment of this disclosure. The shaft driving apparatus 10 comprises a motor 12, a shaft 17, a load 15, and a controller 16. The shaft 17 is operatively coupled to the motor shaft 14 via a shaft coupler 18 and the load 15 is operatively connected to the shaft 17 via a slip joint 20. The shaft 17 is supported by a first bearing assembly 22 and second bearing assembly 24 mounted and fixed external to the motor. In addition, the motor includes internal bearings 11 and 13 which support the motor shaft 14.

To provide the necessary slippage to extend the wear zone of the bearing balls associated with the motor and shaft bearing assemblies, the slip joint 20 includes a slip joint fixed surface 37 rigidly attached to the shaft and a slip joint slipping surface 39 attached to the load 15. The load 15 includes a rotational stop 36 which operates in conjunction with a first 32 and second 34 fixed rotational stop mounted to a rigid surface relative to the load 15. In operation, the first fixed rotational stop 32, the second fixed rotational stop 34, and the load rotational stop 36 provide a threshold angle of rotation 38 for the load prior to slippage occurring within the slip joint 17.

With continuing reference to FIGS. 1A and 1B, the operation of a shaft driving apparatus according to the exemplary embodiment illustrated will be described.

During normal operation, the shaft driving apparatus 10 oscillates within a normal angle of rotation 40 less than the threshold angle 38 determined by the first 32 and second 34 rotational stops. Notable, one application of this limited angular shaft rotation is a decision gate used to route media sheets through a printing system. The decision gate routes the media sheets in one of two directions. This particular application is illustrated in FIGS. 4-8 and is further described below with reference to those figures. As previously discussed in the background section of this disclosure, the limited angular rotation, for example 12°, will create a localized wear zone within the limited angular rotation range 40. Consequently, the bearings associated with the shaft 17 and motor 12 will wear unevenly as compared to a shaft driving apparatus wherein the shaft normally rotates a full rotation or 360°.

To extend the life of the bearings and reduce the effects of the localized wear zone, the shaft driving apparatus 10 overdrives the shaft 17 to an angular position outside the normal limited angular rotational range 40. Stated another way, the motor 12 drives/rotates the load 15 such that the load rotational stop 36 contacts the first 32 or second 34 fixed rotational stops, depending on the direction of shaft rotation. At this point, the motor continues to rotate the shaft 17 and the slip joint 20 provides the necessary slippage to enable the shaft to continue rotating outside the threshold angle of rotation 32, for example 25°. As a result of the shaft rotating outside the normal angle of rotation 40, the ball bearings and raceways within the motor shaft bearing assemblies 22 and 24 are advanced to a position outside the normal angle of rotation 40. After the shaft driving apparatus returns to normal operation where the shaft rotates a limited angle of rotation 40, the corresponding wear zone of the shaft bearings 22 and 24 and the motor bearings is outside the previous wear zone prior to overdriving the shaft 17 beyond the threshold angle of rotation 36.

As a matter of design, the shaft driving apparatus described with reference to FIGS. 1A and 1B may be operated a predetermined time or number of oscillatory cycles within a normal angle of rotation prior to rotating the shaft 17 an angle of rotation greater than the threshold angle of rotation, thereby advancing the motor and shaft bearing balls and associated raceways to a relatively different wear zone. The cycle may be repeated to provide a more uniform wear of the bearing assemblies which would be consistent with a bearing functioning as support for a shaft completing full angular rotations during its normal mode of operation.

With reference to FIG. 2, illustrated is a shaft driving apparatus 50 according to another embodiment of this disclosure. The shaft driving apparatus comprises a load 52, a shaft 53, a slip joint 63 and a pivoting rotational stop 54. The motor and associated bearings for driving the shaft 53 are not illustrated.

The load 52 and shaft 53 are operatively coupled to a slip joint 63 which slips at a threshold angle of rotation 68. During normal operation, the load is restricted to angular movement 70 less than the threshold angle of rotation and the torque applied to the slip joint 63 via the shaft and motor is less than the torque required to produce any slippage within the slip joint 63.

A pivoting rotational stop 54 and load rotational stop 66 provide the necessary torque on the slip joint 63 to enable the shaft 53 to rotate to a predetermined angular position greater than the threshold angle of rotation. As discussed with reference to FIGS. 1A and 1B, this provides for the advancement of bearing balls within the shaft bearing assemblies (not shown) and motor bearing assemblies (not shown) beyond the normal angle of rotation 70 bearing wear zone. The pivoting rotational stop 54 comprises a first rotational stop 64 and a second rotational stop 65. The pivoting rotational stop 54 pivots about a pivot point 62 by a solenoid 56 which is operatively connected to the pivoting rotational stop 54. A return spring 58 attached to a fixed mount 60 provides the necessary return force. In operation, the pivoting rotational stop 54 pivots away from any contact with the load during normal operation. During the slip mode, the pivoting rotational stop pivots to a position as illustrated in FIG. 2.

With reference to FIG. 3, illustrated is an exemplary method of operating a shaft driving apparatus as illustrated and described with reference to FIG. 2.

During step one 82, normal operation is suspended to allow limited slip to occur.

During step two 84, the solenoid 56 is energized by a controller (not shown).

During step three 86, the hard stop pivots into position with respect to the load rotational stop 66.

During step four 88, the motor rotates the shaft so the load rotational stop 66 contacts the pivoting arm rotational stops, 64 and 65, and the slip joint 63 slips.

During step five 90, the motor and shaft 53 stop rotating.

During step six 92, the solenoid 56 is de-energized by the controller and the pivoting rotational stop 54 pivots away from the load 52.

During step seven 94, normal operation resumes and the motor, load and associated load rotate within the normal angel of rotation 70 until the controller or other controlling means initiates step one 82 again and the cycle is repeated.

Figure 4:
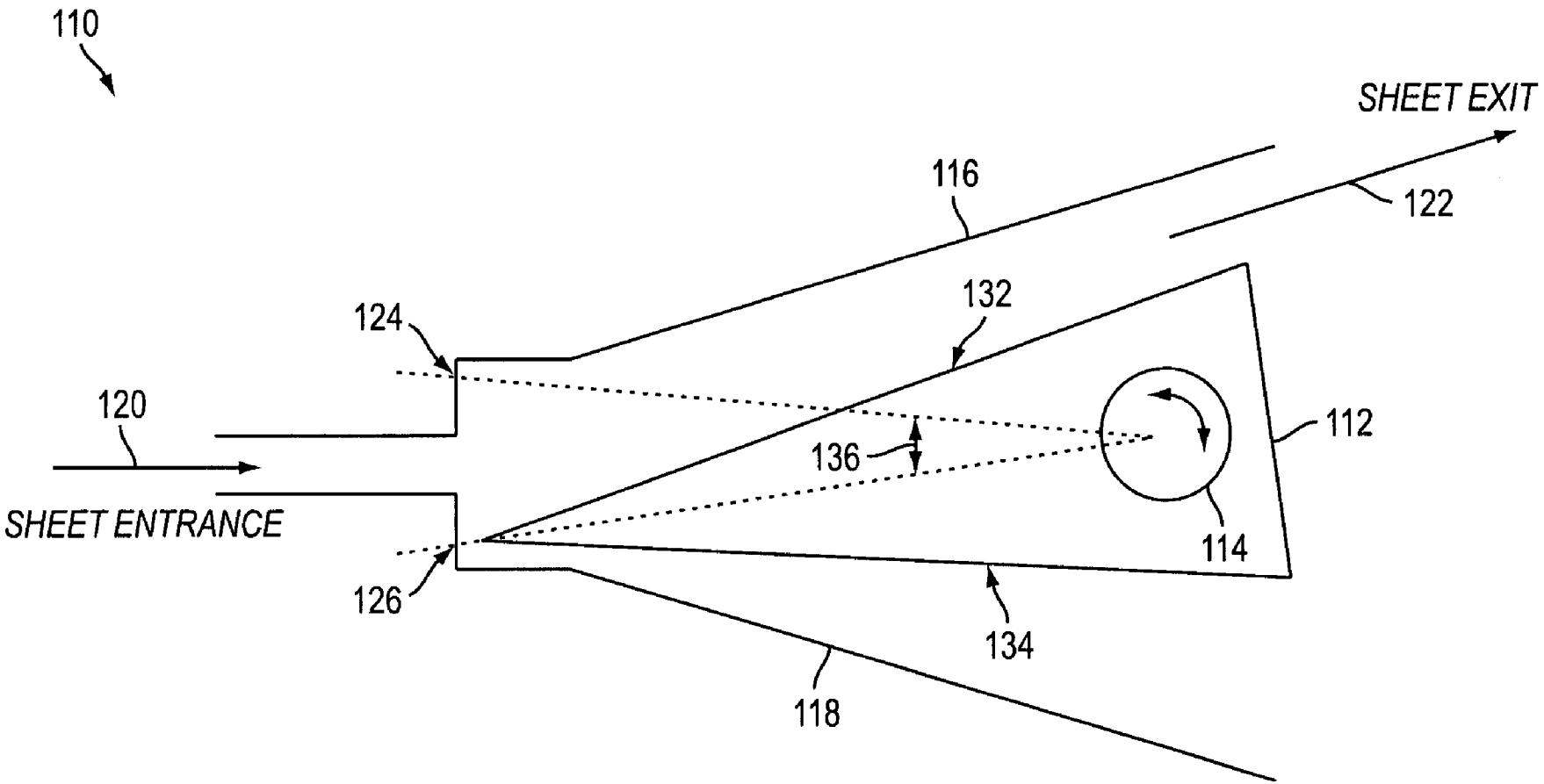
FIG. 4 illustrates a print media gate apparatus according to an exemplary embodiment of this disclosure.

With reference to FIG. 4, illustrated is a print media gate apparatus according to an exemplary embodiment of this disclosure. The print media gate apparatus 110 is one example of an application of a shaft driving apparatus according to this disclosure and discussed with reference to FIGS. 1-3.

The print media gate apparatus 110 comprises a gate 112, a shaft 114, a first baffle member 116, a second baffle member 118, a print media sheet entrance 120 and print media sheet exit 122. The print media gate apparatus 110 is used to route print media sheets in one of two directions within a printing system or print media handling system. For example, the gate 112 within the apparatus 110 can route a print media sheet upwardly with the gate positioned as shown in FIG. 4. In addition, the gate 112 can route a print media sheet downwardly with the gate positioned at angular position 124. Notably, the gate or decision gate 112 is limited to a relatively small normal angle of rotation, for example 12°. Consequently, the wear zone associated with bearing assemblies operatively connected to a shaft 114 and motor (not shown) driving the gate will have a local wear zone corresponding to the normal angle of rotation 136, which is associated with a gate first angular position 124 and a gate second angular position 126.

To provide an extended wear zone within the bearing assemblies a slip joint operatively couples the shaft 114 and gate 112. The gate top surface 132 in conjunction with the top baffle member 116 provide the necessary torque to enable the slip joint to slip when the gate 112 is overdriven while contacting the top baffle member beyond the first angular position 124. Similarly, the gate bottom surface 134 in conjunction with the bottom baffle member 118 provides the necessary torque to enable the slip joint to slip when the gate 112 is overdriven while contacting the bottom baffle member beyond the second angular position 126.

Figure 5:
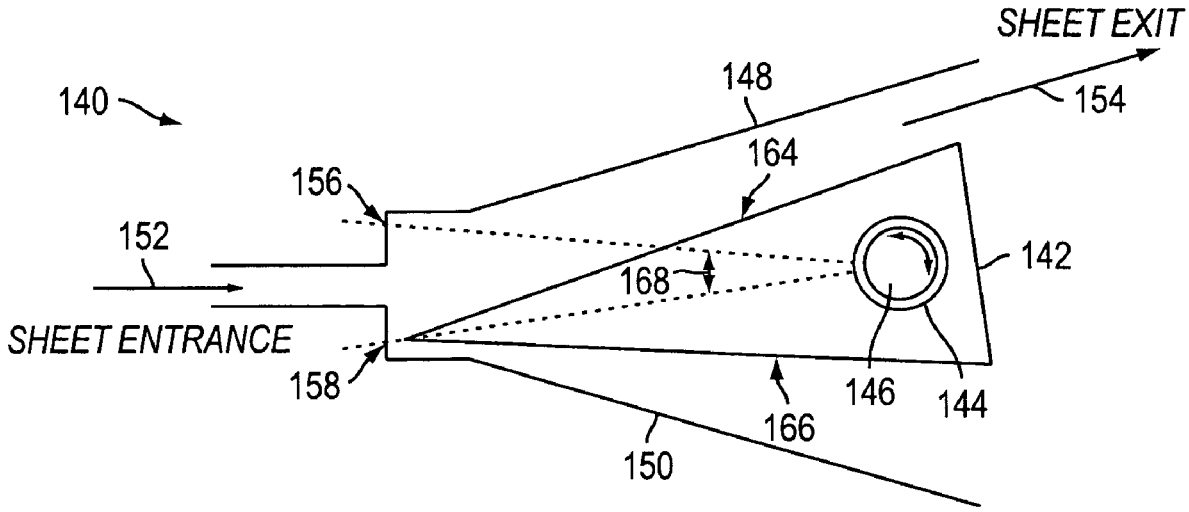
FIG. 5 illustrates a print media gate apparatus according to another exemplary embodiment of this disclosure.

With reference to FIG. 5, illustrated is a print media apparatus according to an exemplary embodiment of this disclosure. The print media gate apparatus 140 comprises a gate 142, a slip joint 144, a shaft 146, a top baffle member 148 and a bottom baffle member 150. The gate 142 comprises a gate top surface 164 and gate bottom surface 166. FIG. 5 illustrates a normal mode of operation where a print media sheet enters the gate apparatus 140 via the sheet entrance 152. The print media sheet is subsequently routed to the sheet exit 154 along the top baffle member 148 by the gate 142 which is positioned at an angular position 158. During this mode of operation no slip occurs at the slip joint 1446.

To provide routing of a print media sheet along the lower baffle member 150, the gate 142 is rotated via the shaft to angular position 156. Notably, during the normal mode of gate operation, any wear associated with the bearing assemblies (not shown) supporting the shaft 146 will be within the gate's normal angle of rotation 168.

Figure 6:
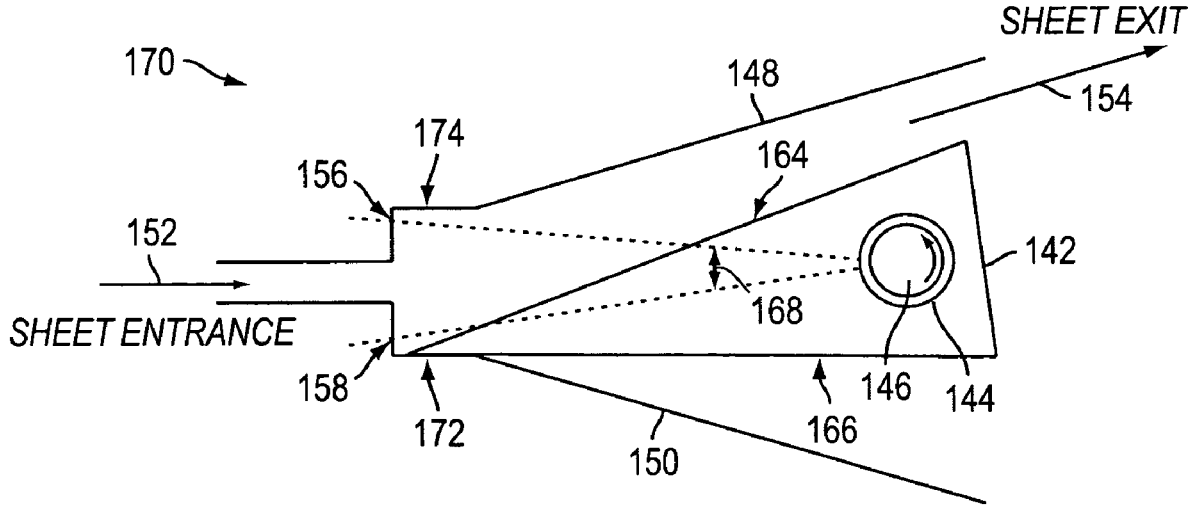
FIG. 6 illustrates a print media gate apparatus according to another exemplary embodiment of this disclosure.

With reference to FIG. 6, illustrated is the print media gate apparatus of FIG. 5 while operating in slip mode. To enable the slip joint to slip, the gate 142 is overdriven to provide contact between the gate bottom surface 166 and the lower baffle member 150 at a gate stop 172. Similarly, the gate and associated gate top surface 164 can be overdriven to contact the upper baffle member 148 at a gate stop 174 to provide the necessary torque to enable the slip joint to slip. After the shaft and associated bearing assemblies are rotated a predetermined or sufficient angular distance, the shaft is rotated away from the gate stop 174 and the print media gate apparatus 170 returns to a normal mode of operation as illustrated and described with reference to FIG. 5.

Figure 7:
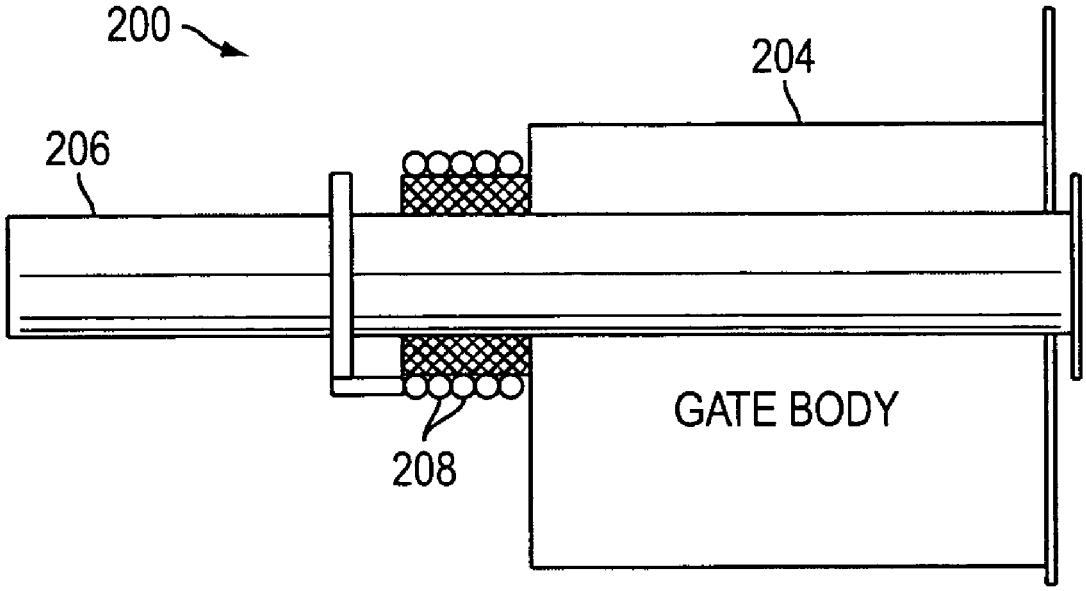
FIG. 7 illustrates a print media gate apparatus according to an exemplary embodiment of this disclosure.

With reference to FIG. 7, illustrated is another exemplary embodiment of a print media gate apparatus 200 according to an exemplary embodiment of this disclosure. The print media gate apparatus 200 comprises a gate body 204, a gate shaft 206 and a clutch 208, for example a wrap spring, hysteresis, magnetic or friction clutch. The clutch 208 is one example of an exemplary means for providing a slip joint or torque limiting device as described heretofore.

Figure 8:
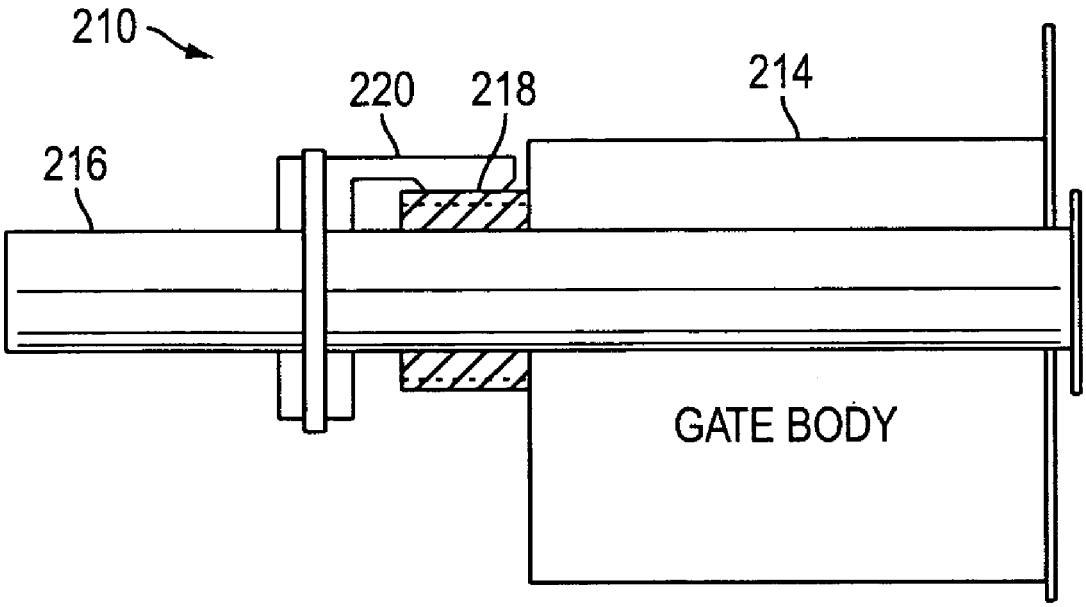
FIG. 8 illustrates a print media gate apparatus according to another exemplary embodiment of this disclosure.
Figure 10A:
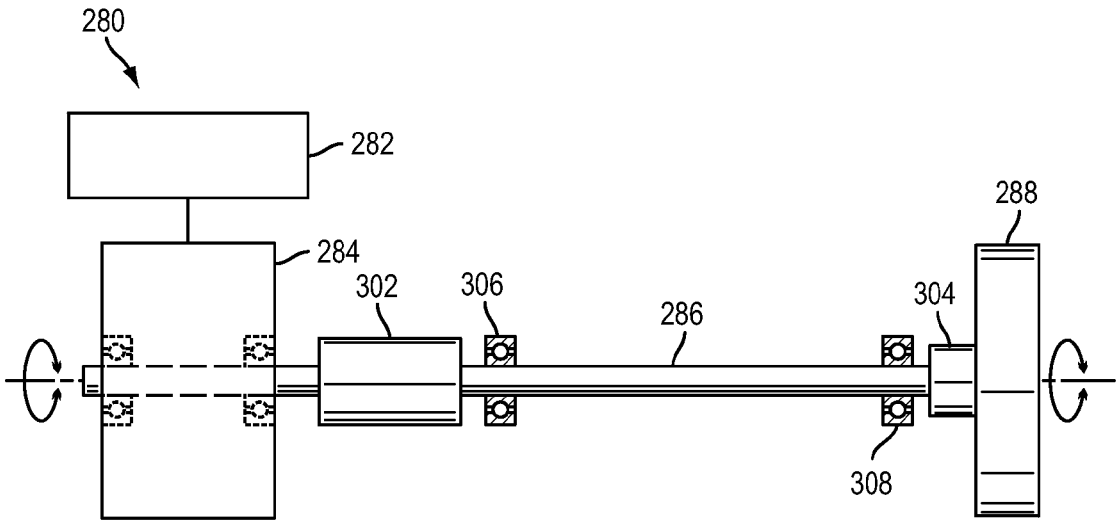
FIG. 10A PRIOR ART
FIGS. 10A and 10B illustrate a conventional shaft driving apparatus.
Figure 10B:
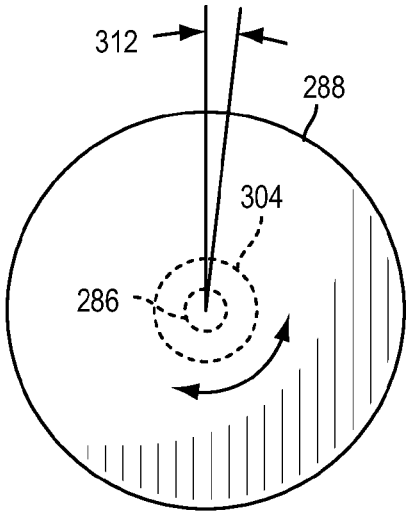
FIG. 10B PRIOR ART

With reference to FIG. 8, illustrated is another exemplary embodiment of a print media gate apparatus 210 according to an exemplary embodiment of this disclosure. The print media gate apparatus 210 comprises a gate body 214, a gate shaft 216, and a ratchet 128 and pawl 220 torque limiting device.

With reference to FIGS. 9A-9C, illustrated is another application of a shaft driving apparatus according to an exemplary embodiment of this disclosure. The exemplary embodiment is a print media tamper apparatus 230 used as a component of a print media stack handling system. Stack handling systems are generally integrated with a print media sheet handling system associated with a printing system.

With reference to FIG. 9A, illustrated is a conventional media sheet stacking system comprising a print media stack 232, a tamper arm 234, and an oscillating drive shaft 240. The tamper arm 234 is oscillated between a tampering position 238 and a released position 236. During operation, a print media sheet is delivered in the direction of the illustrated arrow. As the momentum of the sheet and gravity direct the media sheet downward and towards the tamper arm 234, the tamper arm 234 directs the print media onto the print media stack. During this normal mode of operation, the tamper arm 234 oscillates within a limited angular rotational range. The limits of angular rotation of the shaft 240 which is fixed to the tamper arm 234, are the tamper arm release position 236 and tamper arm tamping position 238.

As previously discussed, the limited angular rotation of the shaft creates a local wear zone within motor and shaft bearing assemblies associated with the shaft.

With reference to FIGS. 9B and 9C, illustrated are a front and side view, respectively, of a tamper apparatus according to an exemplary embodiment of this disclosure. In addition to the features and/or members discussed with reference to FIG. 9A, the tamper apparatus comprises a fixed rotational stop 252, a first shaft bearing 264, a second shaft bearing 266 and a slip joint 268 operatively connected to the tamper arm 234 and shaft 240.

During a normal mode of operation the tamper arm operates in a manner as described with reference to FIG. 9A and the slip-joint does not slip. During a bearing advancement mode, a motor (not shown) overdrives the tamper arm 238 to contact the fixed rotational stop 252 at a tamper arm slip position 251, and causes the slip joint to slip which enables the shaft to continue rotating outside the normal mode limited angle range. Consequently, the bearing balls are advanced within the bearing assemblies 264 and 266 outside of the initial wear zone. Subsequently, the shaft is rotated toward the print media sheet stack which disables the slip-joint from slipping and the tamper arm resumes a normal mode of operation. This cycle can be repeated after a predetermined time duration and/or a predetermined number of tamper oscillations. As with the other embodiments described heretofore, the slip-joint and operation thereof provides a means to enlarge the overall wear zone of a bearing assembly normally used in a limited rotational manner. As a result, the relative reliability of the bearing assemblies is improved.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A shaft driving apparatus comprising:

a shaft including a first end, a second end, and one or more shaft support bearings for supporting rotational movement of the shaft;

a motor, the motor operatively connected to the first end of the shaft and the motor including two or more motor bearings for supporting rotational movement of the shaft;

a controller operatively connected to the motor; and a slip joint, the slip joint including a first portion and a second portion, the slip joint first portion operatively connected to the second end of the shaft, and the slip joint second portion configured to slip at a threshold rotational angle of shaft rotation;

wherein the controller is configured to operate in a nonslip mode of operation to rotate the shaft, the one or more shaft support bearings, the first and second portions of the slip joint, and the two or more motor bearings a first predetermined rotational angle less than or equal to the threshold rotational angle, and the controller is configured to operate in a slip mode of operation to rotate the shaft, the one or more shaft support bearings, the first portion of the slip joint, and the two or more motor bearings a second predetermined rotational angle greater than the threshold rotational angle, and the controller is configured to subsequently return to the nonslip mode of operation, the slip mode of operation advancing a rotational angle associated with the two or more motor bearings and one or more shaft support bearings for subsequent operation in the nonslip mode.

2. The shaft driving apparatus according to claim 1, wherein the second portion of the slip joint is limited to rotating an angle less than or equal to the threshold rotational angle as the shaft, the one or more shaft support bearings, the first portion of the slip joint, and the two or more motor bearings are rotated the second predetermined rotational angle.

3. The shaft driving apparatus according to claim 1, the slip joint comprising:

a torque limiting device.

4. The shaft driving apparatus according to claim 3, the torque limiting device comprising:

a wrap spring, a magnetic clutch or a friction clutch.

5. The shaft driving apparatus according to claim 1, further comprising:

an actuating device operatively connected to the slip joint.

6. The shaft driving apparatus according to claim 5, the actuating device comprising a print media path gate, wherein a first angular position of the gate provides a print media path along a first path and a second angular position of the gate provides a print media path along a second path.

7. The shaft driving apparatus according to claim 5, further comprising:

one or more actuating device stops, wherein the actuating device stops prevent the slip joint second portion from rotating to an angle greater than the threshold angle.

8. The shaft driving apparatus according to claim 5, further comprising:

one or more sensors to control the rotation of the actuating device.

9. A print media apparatus comprising:

a shaft including a first end, a second end, and one or more shaft support bearings for supporting rotational movement of the shaft;

a motor, the motor operatively connected to the first end of the shaft, the motor including two or more motor bearings for supporting rotational movement of the shaft;

a slip joint, the slip joint operatively connected to the second end of the shaft;

a controller operatively connected to the motor; and a print media path gate, the print media path gate operatively connected to the slip joint;

wherein the controller is configured to rotate the print media path gate between a first angular position and a second angular position during a nonslip mode of operation, and the controller is configured to rotate the shaft to a third angular position that is greater than the second angular position or less than the first angular position causing the slip joint to slip during a slip mode of operation, the slip mode of operation rotating the two or more motor bearings and the one or more shaft support bearings to the third angular position, and the controller subsequently returning to the nonslip mode of operation, the slip mode of operation advancing a rotational angle associated with the two or more motor bearings and one or more shaft support bearings for subsequent operation in the nonslip mode.

10. The print media apparatus according to claim 9, wherein the first angular position of the print media path gate directs print media upwardly, and the second angular position of the print media path gate directs print media downwardly.

11. The print media apparatus according to claim 9, further comprising:

one or more baffles to guide print media directed by the print media path gate.

12. The print media apparatus according to claim 9, wherein rotation of the shaft to the third angular position rotates the print media path gate to a reference angular position used to control the angular position of the print media path gate.

* * * * *